US007329980B2

(12) United States Patent
Lim et al.

(10) Patent No.: US 7,329,980 B2
(45) Date of Patent: Feb. 12, 2008

(54) SHADOW MASK FOR CATHODE RAY TUBES

(75) Inventors: Min Ho Lim, Taegu-Si (KR); Jin Tae Park, Kumi-Si (KR); Sang Hyung Kang, Kumi-Si (KR)

(73) Assignee: LG.Philips Displays Korea Co., Ltd., Seoul (KR)

( * ) Notice: Subject to any disclaimer, the term of this patent is extended or adjusted under 35 U.S.C. 154(b) by 41 days.

(21) Appl. No.: 11/302,467

(22) Filed: Dec. 14, 2005

(65) Prior Publication Data

US 2006/0158087 A1 Jul. 20, 2006

(30) Foreign Application Priority Data

Dec. 15, 2004 (KR) ..... 10-2004-0106348
Dec. 28, 2004 (KR) ..... 10-2004-0113560
Dec. 28, 2004 (KR) ..... 10-2004-0113561

(51) Int. Cl.
*H01J 29/80* (2006.01)

(52) U.S. Cl. ..... 313/402; 313/403; 313/407

(58) Field of Classification Search ..... 313/402
See application file for complete search history.

(56) References Cited

U.S. PATENT DOCUMENTS 2,663,821 A * 12/1953 Law ..... 315/1
4,960,659 A * 10/1990 Sagou ..... 430/23
6,072,270 A * 6/2000 Hu et al. ..... 313/402
6,486,596 B1 * 11/2002 Inoue et al. ..... 313/402
6,597,092 B1 * 7/2003 Furusawa et al. ..... 313/402
2001/0050524 A1 * 12/2001 Choe et al. ..... 313/402
2002/0027405 A1 * 3/2002 Im et al. ..... 313/402
2004/0130270 A1 * 7/2004 Azzi et al. ..... 315/5.35

FOREIGN PATENT DOCUMENTS

JP 9-231914 A 9/1997
KR 10-0140148 B1 3/1998
KR 10-0223119 B1 10/1999
KR 2002-0004855 A 1/2002
KR 10-2002-0025771 A 4/2002
KR 10-2004-000332 A 1/2004

* cited by examiner

*Primary Examiner*—Sikha Roy
*Assistant Examiner*—Brian T Schoolman
(74) *Attorney, Agent, or Firm*—Birch, Stewart, Kolasch & Birch, LLP

(57) ABSTRACT

Disclosed herein is a shadow mask for cathode ray tubes. When the width of a smaller hole part of each of slots formed at the shadow mask is defined as Sw, the horizontal distance between the end of a taper-shaped larger hole part facing the panel side of each of the slots, which is adjacent to the edge part of the shadow mask, and the end of the smaller hole part, which is adjacent to the edge part of the shadow mask, is defined as Ta, and the incident angle at which the electron beam passes through each of the slots is defined as θ, the shadow mask has at least one slot through which the electron beam passes at an incident angle θ of above 47 degrees, and the at least one slot through which the electron beam passes at an incident angle θ of above 47 degrees is configured such that the following inequality is satisfied: 1<Ta/Sw<2.

15 Claims, 7 Drawing Sheets

SHADOW MASK FOR CATHODE RAY TUBES

BACKGROUND OF THE INVENTION

1. Field of the Invention

The present invention relates to a shadow mask for cathode ray tubes (CRTS), and, more particularly, to a shadow mask for cathode ray tubes having slots whose shapes are optimized to prevent interference between the slots and an electron beam, which may occur in wide-angle slim-type cathode ray tubes.

2. Description of the Related Art

FIG. 1 is a side view, partially in section, showing the inner structure of a conventional cathode ray tube.

As shown in FIG. 1, the conventional cathode ray tube comprises a panel 1, a funnel 2, a shadow mask 3, a screen 4, a frame 5, a spring 6, an inner shield 7, a deflection yoke 8, an electron gun 9, and a reinforcing band 10.

The conventional cathode ray tube is operated as follows: an electron beam emitted from the electron gun 9 is vertically and horizontally deflected by the deflection yoke 8, which is disposed at a neck part of the funnel 2, and then arrives at the screen 4, i.e., a fluorescent surface applied to the inner surface of the panel 1, through slots formed at the shadow mask 3. At this time, the screen 4 emits light by energy of the electron beam such that a picture is reproduced, and therefore, a user can watch the picture reproduced through the panel 1.

Generally, the shadow mask 3 is supported while the shadow mask 3 is in parallel with the panel 1. To this end, the frame 5 of the cathode ray tube is fixed to one side of the shadow mask by welding. Also, the spring is disposed between the frame 5 and the panel 1 for securely connecting the frame 5 to the panel 1.

The inner shield 7 of the cathode ray tube intercepts terrestrial magnetism to prevent the path along which the electron beam moves from being curved by the terrestrial magnetism. Also, the reinforcing band 10 is attached to the cathode ray tube for dispersing stress applied to the panel 1.

The cathode ray tube has a total length greater than those of the other display units, such as a liquid crystal display (LCD) or a plasma display panel (PDP), which results from its picture reproduction method. For this reason, various efforts have been made recently to slim the cathode ray tube. This is because that slimness of the cathode ray tube considerably strengthens the competitiveness of the cathode ray tube.

The slimmed cathode ray tube has a decreased total length. As a result, the deflection angle of the electron beam is increased. When the deflection angle of the electron beam is increased, interference occurs between the electron beam and the shadow mask, which will be described below in detail with reference to FIG. 2.

FIG. 2 is a view showing paths along which the electron beam passes through a slot 3*a* of the shadow mask 3.

In the case of the conventional cathode ray tube, the deflection angle between catercornered ends of the effective surface of the panel from the center of deflection is approximately 90 degrees to 110 degrees. In the case of the wide-angle slim-type cathode ray tube having a total length of 35 cm or less, on the other hand, the center of deflection is shifted toward the panel as a result of the reduction of the total length, and therefore, the deflection angle is increased up to 120 degrees or more.

One of the paths shown in FIG. 2 is a path along which the electron beam passes through the slot 3*a* formed at the shadow mask 3 in the conventional cathode ray tube, and the other path shown in FIG. 2 is a path along which the electron beam passes through the slot 3*a* formed at the shadow mask 3 in the slim-type cathode ray tube. Specifically, FIG. 2 shows a case that the electron beam passes through the slot of the shadow mask 3 at a deflection angle of $\beta$ for the conventional cathode ray tube and another case that the electron beam passes through the slot of the shadow mask 3 at a deflection angle of $\alpha$ for the slim-type cathode ray tube.

In the path along which the electron beam passes through the shadow mask 3 applied to the slim-type cathode ray tube, the electron beam passing through the shadow mask 3 at a deflection angle of $\alpha$ collides with one side of the slot of the shadow mask 3, with the result that interference occurs between the electron beam and the slot of the shadow mask 3.

FIG. 3 is a view showing the shapes of a normal electron beam and a distorted electron beam. When interference occurs between the electron beam and the slot of the shadow mask, the shape of the electron beam is distorted as shown in FIG. 3. This distortion decreases the amount of electron beam arriving at the fluorescent body, which affects brightness of the cathode ray tube.

In order to solve the problem caused by the interference described above, it is necessary to appropriately change the shape of the slot 3*a* formed at the shadow mask 3. Especially, it is preferable to increase the width of the slot 3*a* of the shadow mask 3, which prevents interference between the electron beam and the slot of the shadow mask 3.

As the cathode ray tube becomes large and flat, the shadow mask 3 is also formed flat. As a result, the structural strength of the shadow mask 3 is decreased, and therefore, several problems, such as curvature distortion and vibration caused by external impacts and heat distortion, are generated.

When the width of the slot 3*a* formed at the shadow mask 3 is increased, the structural strength of the shadow mask 3 is further decreased. Consequently, a method of increasing the structural strength of the shadow mask is required.

SUMMARY OF THE INVENTION

Therefore, the present invention has been made in view of the above problems, and it is an object of the present invention to provide a shadow mask for wide-angle slim-type cathode ray tubes having slots whose shapes are appropriately changed to prevent interference between the slots and an electron beam, thereby preventing distortion of a picture and decrease of brightness at the edge parts of the respective cathode ray tubes.

It is another object of the present invention to provide a shadow mask for cathode ray tubes wherein the width of each slot of the shadow mask is decreased or the arrangement of the slots is appropriately changed within the range in which interference does not occur between the shadow mask and the electron beam such that the shadow mask is flattened, and the decrease of the structural strength of the shadow mask due to the increase of the width of each slot of the shadow mask is prevented.

In accordance with the present invention, the above and other objects can be accomplished by the provision of a shadow mask for cathode ray tubes, the shadow mask having a plurality of slots through which an electron beam passes for sorting colors of the electron beam, wherein, when the width of a smaller hole part of each of the slots through which the electron beam passes is defined as Sw, the horizontal distance between the end of a taper-shaped larger hole part facing the panel side of each of the slots, which is adjacent to the edge part of the shadow mask, and the end of the smaller hole part, which is adjacent to the edge part of the shadow mask, is defined as Ta, and the incident angle at which the electron beam passes through each of the slots is defined as θ the shadow mask has at least one slot through which the electron beam passes at an incident angle θ of above 47 degrees, and the at least one slot through which the electron beam passes at an incident angle θ of above 47 degrees is configured such that the following inequality is satisfied: $1<Ta/Sw<2$.

Preferably, when the thickness of the shadow mask is defined as t, the at least one slot of the shadow mask is configured such that the following inequality is further satisfied: $1<Ta/t<2$.

Preferably, the at least one slot of the shadow mask is configured such that the following inequality is further satisfied: $Ta<0.380$ mm.

According to a second preferred embodiment of the present invention, the end of the larger hole part, which is adjacent to the center part of the shadow mask, is protruded toward the center of each of the slots such that an area of each of the slots is decreased to increase the structural strength of the shadow mask.

Preferably, the end of the larger hole part, which is adjacent to the center part of the shadow mask, is located nearer to the center part of the shadow mask than the center of the smaller hole part, and, when the horizontal distance between the end of the larger hole part, which is adjacent to the center part of the shadow mask, and the center of the smaller hole part is defined as Di, the at least one slot is configured such that the following inequality is satisfied: $0 \leqq Di \leqq Sw/2$.

Preferably, the end of the larger hole part, which is adjacent to the center part of the shadow mask, is located nearer to the edge part of the shadow mask than the center of the smaller hole part, and, when the width of the larger hole part is defined as D, the at least one slot is configured such that the following inequality is satisfied: $D \geqq Sw$.

Preferably, when the width of the larger hole part is defined as D and the thickness of the shadow mask is defined as t, the at least one slot is configured such that the following inequality is satisfied: $D \leqq 2.5 \times t$.

According to a third preferred embodiment of the present invention, when the horizontal distance from the center of one slot of the shadow mask to the center of another adjacent slot is defined as Ph, the shadow mask is configured such that Ph(A) of the center part of the shadow mask and Ph(F) of the catercornered end of the effective surface of the shadow mask satisfy the following inequality: $140\% \leqq F/A \leqq 180\%$, whereby the strength at the end of the shadow mask is relatively increased as compared to the center part of the shadow mask.

Preferably, when Ph of the end of the effective surface of the shadow mask in the direction of the major axis is defined as D, the shadow mask is configured such that the following inequality is satisfied: $140\% \leqq D/A \leqq 180\%$.

Preferably, when Ph at the position corresponding to ½ of the distance from the center part of the shadow mask to the end of the shadow mask in the direction of the minor axis is defined as B, and Ph at the position corresponding to ½ of the distance from the end of the effective surface of the shadow mask in the direction of the major axis to the end of the shadow mask in the direction of the minor axis is defined as E, the shadow mask is configured such that the following inequality is satisfied: $140\% \leqq E/B \leqq 180\%$.

Preferably, when Ph at the end of the effective surface of the shadow mask in the direction of the minor axis is defined as C, the shadow mask is configured such that the following inequality is satisfied: $140\% \leqq F/C \leqq 180\%$. Also preferably, the shadow mask is configured such that Ph(A) of the center part of the shadow mask and Ph(F) of the catercornered end of the effective surface of the shadow mask further satisfy the following inequality: $150\% \leqq F/A \leqq 180\%$.

Preferably, the shadow mask is applied to a slim-type cathode ray tube having a deflection angle of 120 degrees or more.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
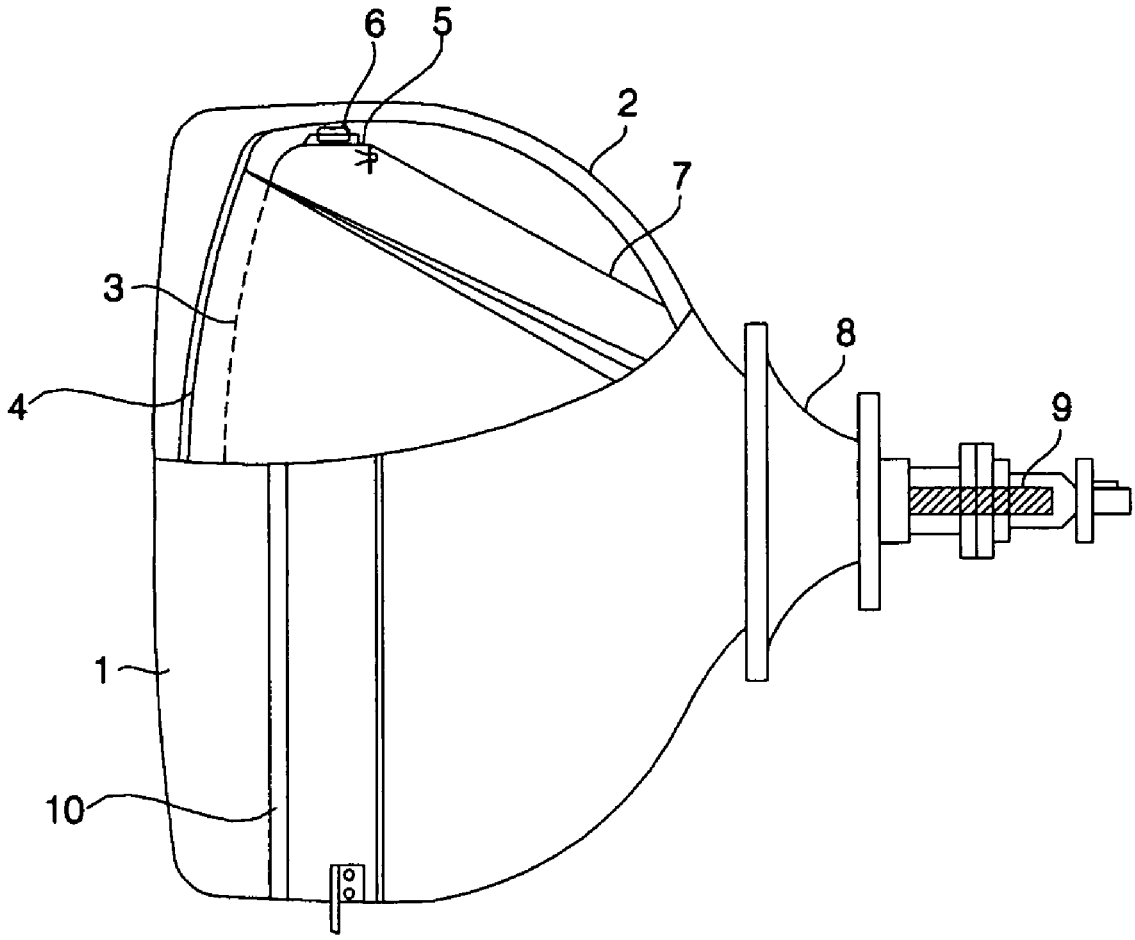
FIG. 1 (Prior Art)
FIG. 1 is a side view, partially in section, showing the inner structure of a conventional cathode ray tube.
Figure 2:
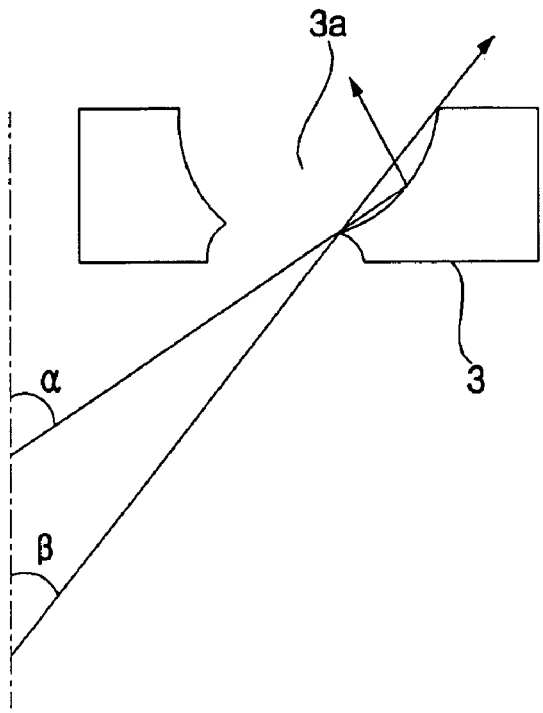
FIG. 2 (Prior Art)
FIG. 2 is a view showing paths along which an electron beam passes through a slot of a shadow mask.
Figure 3:
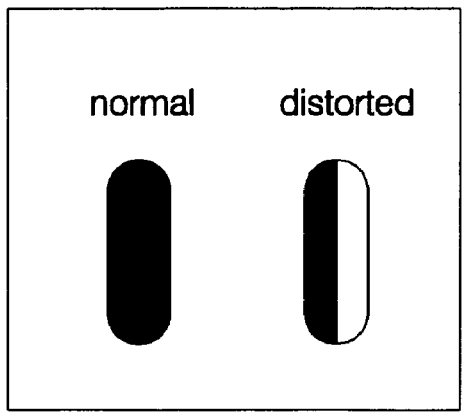
FIG. 3 (Prior Art)
FIG. 3 is a view showing the shapes of a normal electron beam and a distorted electron beam.

Now, preferred embodiments of the present invention will be described in detail with reference to the accompanying drawings. In the drawings, the same elements are denoted by the same reference numerals even though they are depicted in different drawings.

Figure 4:
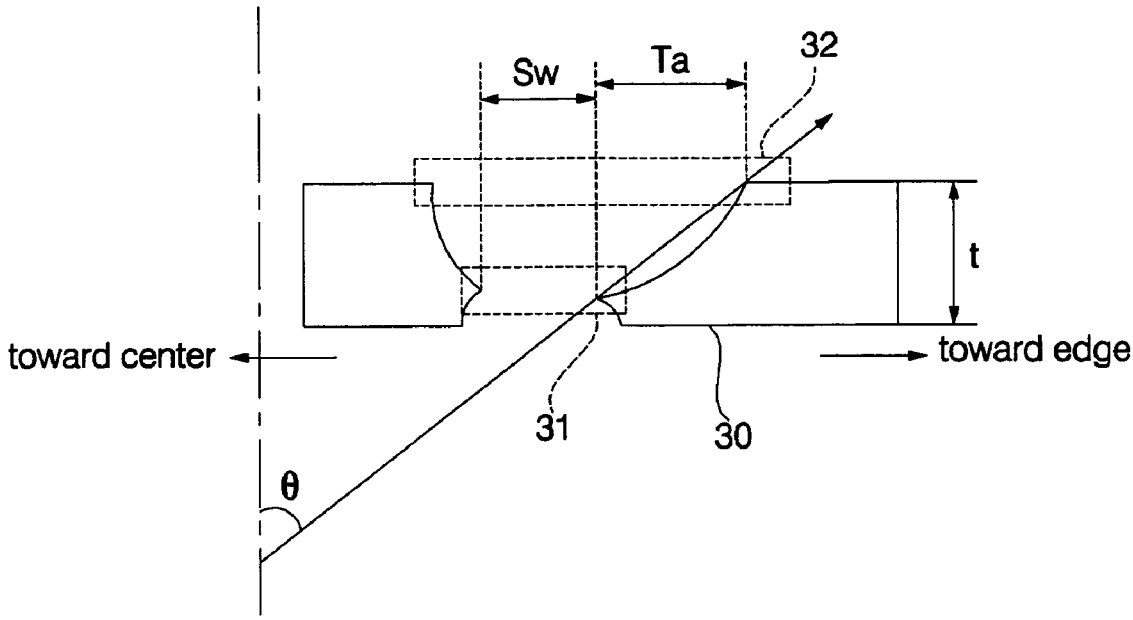
FIG. 4 is a view showing a shadow mask with the width of a larger hole part increased according to the present invention.
Figure 5:
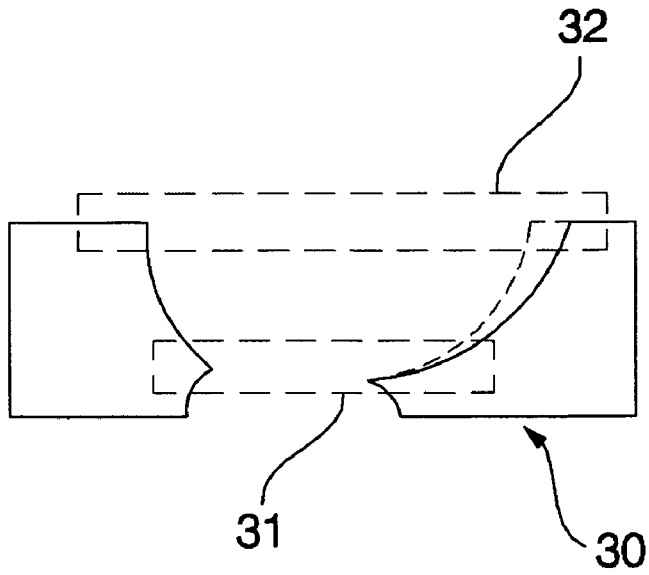
FIG. 5 is a view showing comparison between a slot of the shadow mask according to the present invention and a slot of the conventional shadow mask.
Figure 6:
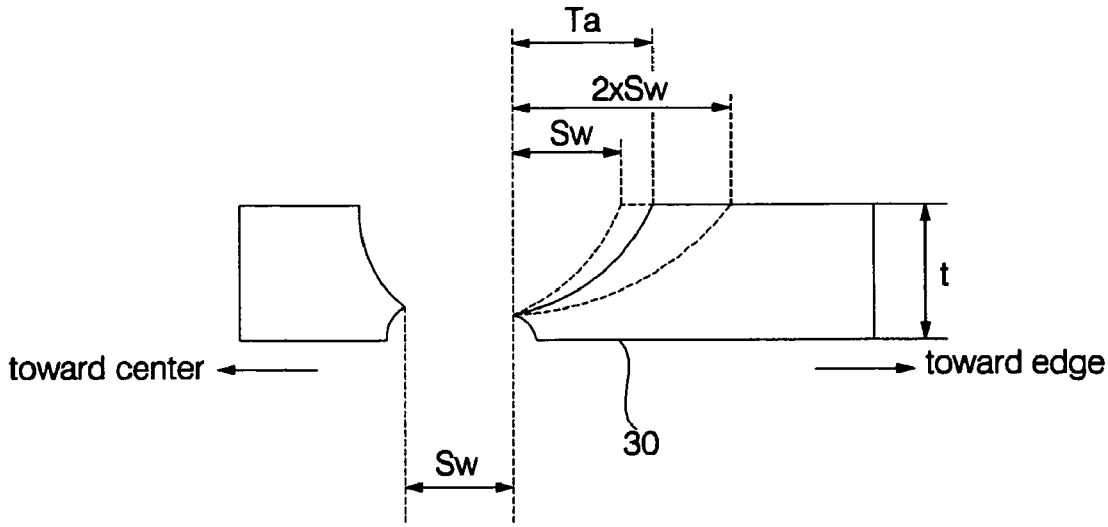
FIGS. 6 and 7 are views respectively showing ranges of the widths of the larger hole part of the shadow mask according to the present invention.
Figure 7:
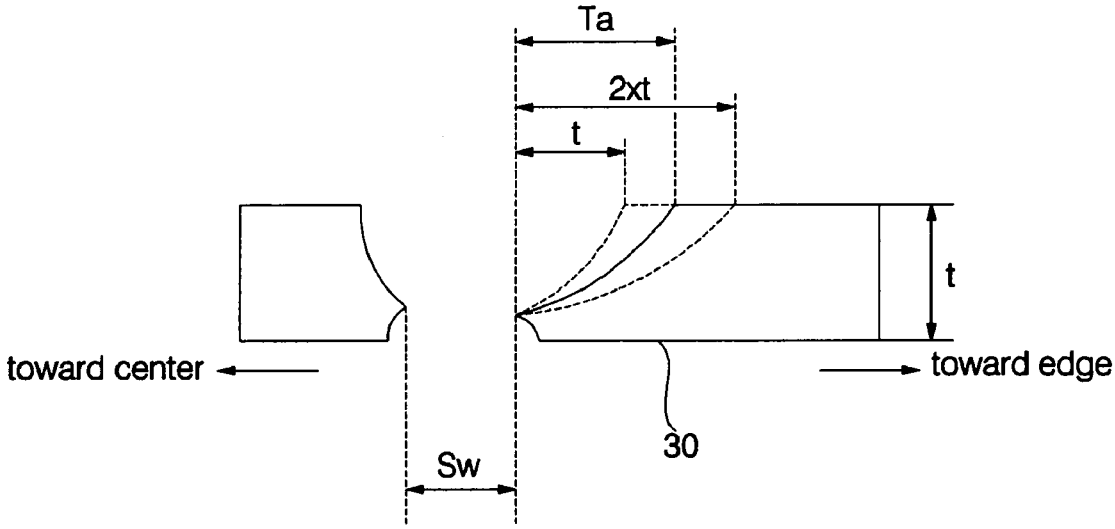

FIG. 4 is a view showing a shadow mask 30 with the width of a larger hole part increased according to the present invention, FIG. 5 is a view showing comparison between a slot of the shadow mask according to the present invention and a slot of the conventional shadow mask, and FIGS. 6 and 7 are views respectively showing ranges of the widths of the larger hole part of the shadow mask according to the present invention.

As shown in FIG. 4, a slot for sorting colors of the electron beam is formed at the shadow mask 30. Actually, the shadow mask has a plurality of slots. However, only one slot is drawn and described for clarity of illustration and description. The slot includes a smaller hole part 31 having the narrowest width and a larger hole part 32 formed in the shape of a taper, which faces the panel side of the slot. The width of the smaller hole part 31 is defined as Sw, the horizontal distance between the end of the larger hole part, which is adjacent to the edge part of the shadow mask 30, and the end of the smaller hole part, which is adjacent to the edge part of the shadow mask 30, is defined as Ta, and the incident angle at which the electron beam passes through the slot is defined as θ.

The incident angle θ is an angle of the electron beam passing through the slot to the central axis. The incident angle θ of the electron beam for the slim-type cathode ray tube is wider than that of the electron beam for the conventional cathode ray tube.

FIG. 5 is a view showing comparison between the slot of the shadow mask according to the present invention and the slot of the conventional shadow mask. The larger hole part 32 of the slot formed at the shadow mask according to the present invention is drawn in a solid line. As shown in FIG. 5, the width of the larger hole part 32 of the slot formed at the shadow mask according to the present invention is greater than that of the larger hole part of the slot formed at the conventional shadow mask, which is drawn in a dotted line.

The electron beam collides with one side of the larger hole part 32, which is adjacent to the edge part of the shadow mask, with the result that interference occurs between the electron beam and the larger hole part 32. Consequently, it is preferable to cut off the side of the larger hole part 32, which is adjacent to the edge part of the shadow mask, so as to increase the width of the larger hole part 32.

When the shadow mask according to the present invention is applied to the slim-type cathode ray tube, the shadow mask has at least one slot through which the electron beam passes at an incident angle θ of above 47 degrees. At this time, the slot through which the electron beam passes at an incident angle θ of above 47 degrees is preferably configured such that Ta satisfies the following inequality: $1<Ta/Sw<2$.

When the width of the larger hole part 32 is to be adjusted, the horizontal distance Ta between the end of the larger hole part 32, which is adjacent to the edge part of the shadow mask 30, and the end of the smaller hole part 31, which is adjacent to the edge part of the shadow mask 30, is adjusted as shown in FIG. 4.

Also, interference between the electron beam and the slot occurs when the incident angle of the electron beam is a wide angle having more than a predetermined value. Consequently, it is preferable to increase the value of Ta as long as the incident angle θ is above 47 degrees.

On the other hand, interference between the electron beam and the slot is affected by the width Sw of the smaller hole part of the shadow mask 30. Consequently, it is required that the value of Ta satisfy a predetermined range according to the inequality regarding the value of Sw when the value of Ta is increased.

According to the present invention, the ratio of the value of the distance Ta between the end of the larger hole part and the end of the smaller hole part to the width Sw of the smaller hole part is between 1 and 2.

Generally, the slot is largely formed at the shadow mask 30 as the slot approaches the edge part of the shadow mask 30 from the center part of the shadow mask 30 such that the amount of electron beam passing through the slot is increased. In this case, however, the transmittance of the electron beam through the edge part of the panel is low as the panel of the cathode ray tube is gradually thicker from the center part to the edge part of the panel. As a result, bright uniformity (B/U) is lowered. Consequently, the width of the slot formed at the edge part of the shadow mask 30 is increased to increase the brightness, and therefore, to increase the bright uniformity.

The deflection angle θ of the electron beam is gradually increased as it approaches the edge part of the shadow mask 30. Consequently, it is necessary to increase the value of Ta. As the value of the width Sw of the smaller hole part is increased as it approaches the edge part of the shadow mask 30 as described above. Consequently, the value of Ta is also increased while Ta satisfies the following inequality: $1<Ta/Sw<2$, and therefore, interference between the electron beam and the slot due to collision of the electron beam with the slot is prevented.

The requirement that the value of Ta satisfies the following inequality: $Ta/Sw<2$ is to prevent the decrease of the structural strength of the shadow mask 30, which may occur when the value of Ta is excessively increased.

When the value of Ta is increased to prevent interference between the electron beam and the slot, it is required that the value of Ta satisfy a predetermined range according to the inequality regarding the value of the thickness t of the shadow mask 30.

In the shadow mask according to the present invention, it is preferable to configure the slot of the shadow mask such that Ta further satisfies the following inequality: $1<Ta/t<2$, where t is the thickness of the shadow mask.

Generally, reduction of the thickness of the shadow mask 30 is restricted due to its drop characteristic. Generally, the shadow 30 has a thickness of 0.22 mm or 0.25 mm.

When the thickness of the shadow mask 30 is increased, the height of one side of the slot with which the electron beam collides is increased. As a result, the interference between the electron beam and the slot may easily occur as compared to the shadow mask 30 having a relatively small thickness. Consequently, it is preferable to configure the slot such that the value of Ta is increased while the value of Ta satisfies the above-mentioned range as the thickness t of the shadow mask is increased.

The requirement that the value of Ta satisfies the following inequality: $Ta/t<2$ is also to prevent the decrease of the structural strength of the shadow mask 30, which may occur when the value of Ta is excessively increased.

FIGS. 6 and 7 are views respectively showing ranges of the widths of the larger hole part of the shadow mask according to the present invention.

As shown in FIG. 6, the width of the larger hole part of the slot formed at the shadow mask is increased. When the width of the larger hole part is increased, the width of the large hole part is increased toward the edge part of the shadow mask 30 to prevent interference between the electron beam and the slot.

The larger hole part of the slot of the shadow mask according to the present invention, which is drawn in a solid line, is designed such that the width of the large hole part is between Sw and 2×Sw so as to prevent interference between the electron beam and the slot and to prevent the decrease of the structural strength of the shadow mask due to the excessive increase of the width of the slot.

As shown in FIG. 7, the larger hole part of the slot of the shadow mask according to the present invention, which is drawn in a solid line, is designed such that the width of the large hole part is between t and 2×t.

The shadow mask with the above-stated construction according to the preferred embodiment of the present invention will be described hereinafter with reference to the following Tables.

TABLE 1

| | x | | | | | | | |
|---|---|---|---|---|---|---|---|---|
| | 0 | 48 | 95 | 142 | 188 | 234 | 278 | 305 |
| Sw | 0.163 | 0.168 | 0.175 | 0.188 | 0.200 | 0.213 | 0.225 | 0.238 |
| Ta | 0.000 | 0.941 | 0.082 | 0.108 | 0.144 | 0.168 | 0.199 | 0.217 |
| θ | 0.0 | 9.4 | 18.1 | 23.3 | 30.0 | 34.0 | 38.5 | 40.9 |
| Ta/Sw | 0.0 | 0.2 | 0.5 | 0.6 | 0.7 | 0.8 | 0.9 | 0.9 |
| Ta/t | 0.0 | 0.2 | 0.3 | 0.4 | 0.6 | 0.7 | 0.8 | 0.9 |

(Thickness of the shadow mask: 0.25 mm)

TABLE 2

| | x | | | | | | | |
|---|---|---|---|---|---|---|---|---|
| | 0 | 48 | 95 | 142 | 188 | 234 | 278 | 305 |
| Sw | 0.163 | 0.168 | 0.175 | 0.188 | 0.200 | 0.213 | 0.225 | 0.238 |
| Ta | 0.000 | 0.069 | 0.136 | 0.179 | 0.237 | 0.274 | 0.316 | 0.335 |
| θ | 0 | 15 | 29 | 36 | 43 | 48 | 52 | 53 |
| Ta/Sw | 0.0 | 0.4 | 0.8 | 1.0 | 1.2 | 1.3 | 1.4 | 1.4 |
| Ta/t | 0.0 | 0.3 | 0.5 | 0.7 | 0.9 | 1.1 | 1.3 | 1.3 |

(Thickness of the shadow mask: 0.25 mm)

TABLE 3

| | x | | | | | | | |
|---|---|---|---|---|---|---|---|---|
| | 0 | 48 | 95 | 142 | 188 | 234 | 278 | 305 |
| Sw | 0.143 | 0.147 | 0.154 | 0.165 | 0.176 | 0.187 | 0.198 | 0.209 |
| Ta | 0.000 | 0.061 | 0.120 | 0.158 | 0.208 | 0.241 | 0.278 | 0.295 |
| θ | 0 | 15 | 29 | 36 | 43 | 48 | 52 | 53 |
| Ta/Sw | 0.0 | 0.4 | 0.8 | 1.0 | 1.2 | 1.3 | 1.4 | 1.4 |
| Ta/t | 0.0 | 0.2 | 0.5 | 0.6 | 0.8 | 1.0 | 1.1 | 1.2 |

(Thickness of the shadow mask: 0.22 mm)

Table 1 shows the ratio of the value of Ta to the respective values of Sw and t according to the prior art, and Tables 2 and 3 show the ratio of the value of Ta to the respective values of Sw and t according to the present invention.

As can be seen from Table 1, the value of Ta was increased as the width of the slot of the conventional shadow mask 30 was increased from the center part of the shadow mask toward the edge part of the shadow mask. However, the ratio of Ta to Sw (Ta/Sw) was below 1, and the ratio of Ta to t (Ta/t) was also below 1. When the slot was formed at the shadow mask, which was applied to the slim-type cathode ray tube, based on the above-mentioned ratios according to the prior art, interference between the electron beam and the slot was not effectively prevented.

As can be seen from Tables 2 and 3, the value of Ta was increased as the width of the slot of the smaller hole part 31 of the slot of the shadow mask 30 was increased from the center part of the shadow mask toward the edge part of the shadow mask along the long side of the shadow mask 30. Especially, the ratio of Ta to Sw (Ta/Sw) of the slot through which the electron beam passed at an incident angle θ of above 47 was between 1 and 2.

When the thickness t of the shadow mask was 0.25 mm or 0.22 mm, the value of Ta of the slot through which the electron beam passed at an incident angle θ of above 47 was greater than the thickness t of the shadow mask. Especially, the ratio of Ta to t (Ta/t) of the slot through which the electron beam passes at an incident angle θ of above 47 was between 1 and 2.

The slot of the shadow mask 30 is formed as described above to effectively prevent interference between the slot and the electron beam. When the slot is formed at the shadow mask such that interference does not occur between the slot and the electron beam, the decrease of the structural strength of the shadow mask 30, which may occur when the width of the slot is excessively increased, is prevented.

Preferably, the slot of the shadow mask is formed such that the width Ta of the slot further satisfies the following inequality: Ta<0.380 mm, whereby the decrease of the structural strength of the shadow mask 30 is effectively prevented.

Figure 8:
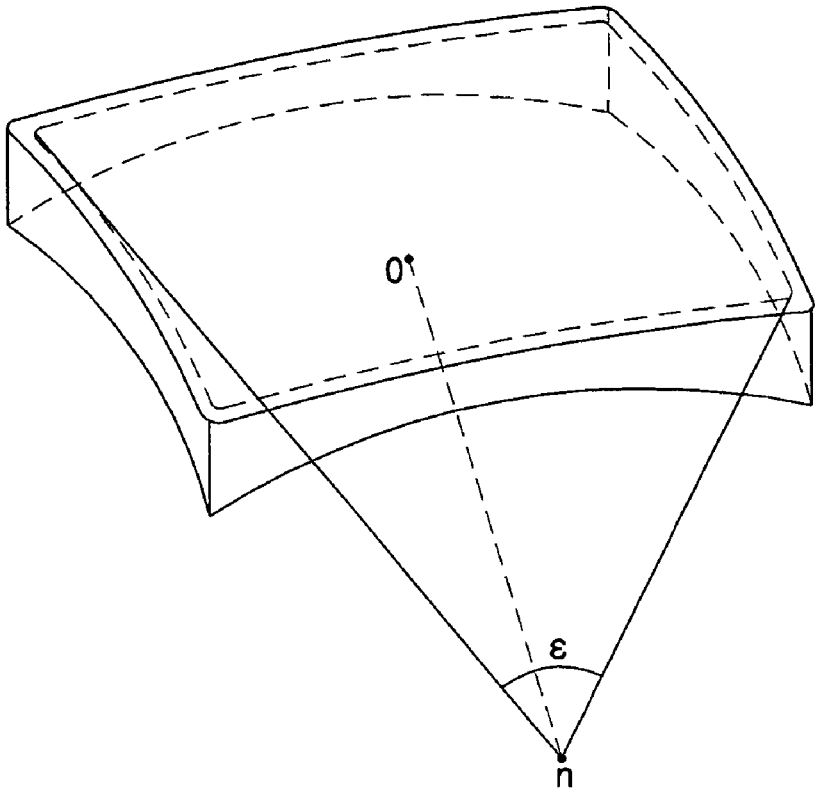
FIG. 8 is a view showing the deflection angle of a cathode ray tube.

FIG. 8 is a view showing the deflection angle of the cathode ray tube. As shown in FIG. 8, the angle between catercornered ends of the effective surface of the panel 1 from the center n of deflection is defined as ϵ.

The shadow mask for cathode ray tubes with the above-stated construction according to the present invention can be applied to the slim-type cathode ray tube having a deflection angle ϵ of 120 degrees or more, thereby providing desirable effects, which has already been described above.

When the slot is largely formed at the shadow mask, the structural strength of the shadow mask is decreased, and therefore, several problems, such as curvature distortion and vibration caused by external impacts and heat distortion, are generated. Consequently, it is preferable to increase the structural strength of the shadow mask at which the slot is largely formed as described above.

According to a second preferred embodiment of the present invention, the end of the larger hole part, which is adjacent to the center part of the shadow mask, is protruded toward the center of the slot such that an area of the slot is decreased to increase the structural strength of the shadow mask.

The shadow mask according to the second preferred embodiment of the present invention will be described below in detail with reference to FIGS. 9 to 11.

Figure 9:
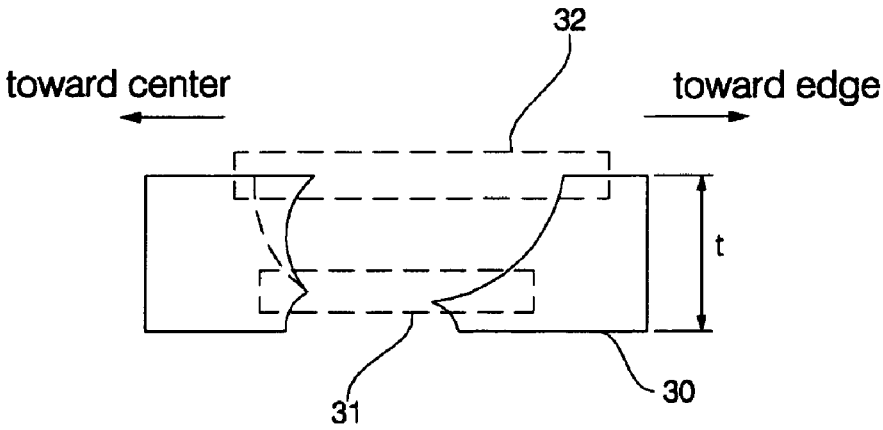
FIG. 9 is a view showing the shape of a slot of a shadow mask according to a second preferred embodiment of the present invention.
Figure 10:
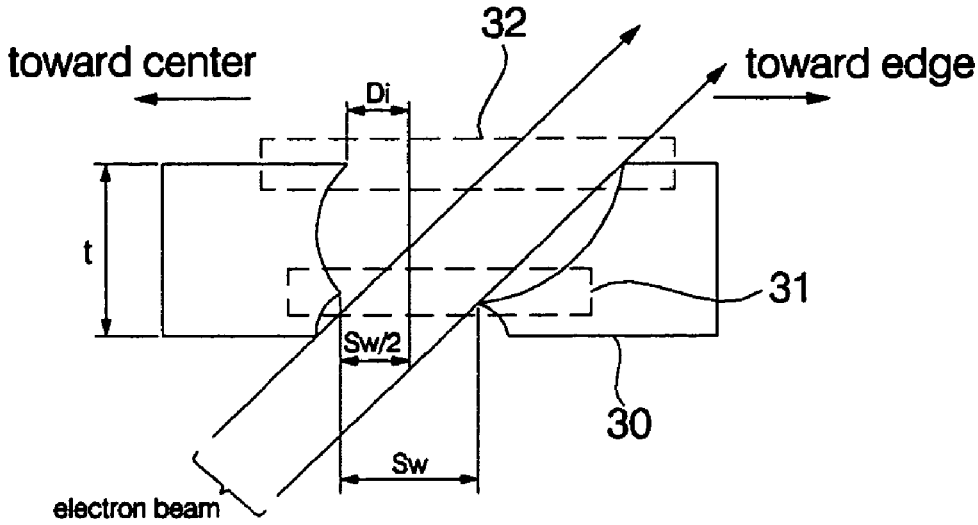
FIGS. 10 and 11 are views respectively showing the shapes of the slot of the shadow mask with the width of a larger hole part decreased.
Figure 11:
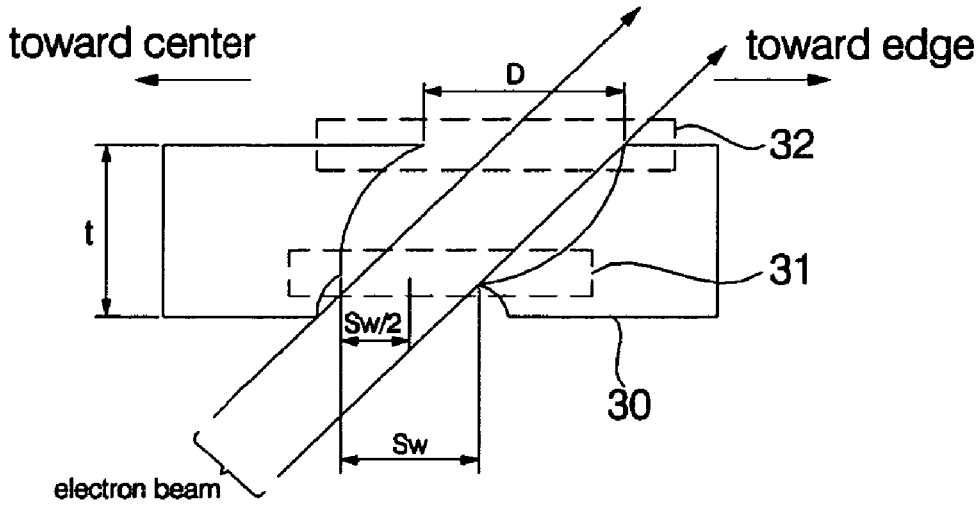

FIG. 9 is a view showing the shape of the slot of the shadow mask according to the second preferred embodiment of the present invention, and FIGS. 10 and 11 are views respectively showing the shapes of the slot of the shadow mask with the width of the larger hole part decreased.

As shown in FIG. 9, the slot of the shadow mask 30 comprises the smaller hole part 31 and the larger hole part 32, as in the first preferred embodiment of the present invention. The width of the shadow mask 30 is defined as t.

One end of the large hole part 32, which is adjacent to the edge part of the shadow mask 30, has a width sufficient to prevent interference between the electron beam and the slot, as has already been described in connection with the previous embodiment of the present invention.

The other end of the larger hole part 32, which is adjacent to the center part of the shadow mask 30, has no connection with the interference between the electron beam and the slot. Consequently, the end of the larger hole part 32, which is adjacent to the center part of the shadow mask 30, may be protruded toward the center of the slot.

The end of the larger hole part 32, which is adjacent to the center part of the shadow mask 30, is formed as drawn in a dotted line according to the prior art. On the other hand, the end of the larger hole part 32, which is adjacent to the center part of the shadow mask 30, is formed as drawn in a solid line according to the second preferred embodiment of the present invention.

When the end of the larger hole part 32, which is adjacent to the center part of the shadow mask 30, is formed as described above according to the second preferred embodiment of the present invention, the width of the slot of the shadow mask 30 is decreased irrespective of the interference between the electron beam and the slot. As a result, the structural strength of the shadow mask is increased, and therefore, several problems, such as curvature distortion and vibration caused by external impacts and heat distortion, are eliminated.

When the shape of the end of the larger hole part 32, which is adjacent to the center part of the shadow mask 30, is changed, it is required to consider interference between the electron beam and the slot and easiness in forming the slot.

As shown in FIG. 10, the width of the smaller hole part 31 is defined as Sw, and the horizontal distance between the end of the larger hole part 32, which is adjacent to the center part of the shadow mask 30, and the center of the smaller hole part 31 is defined as Di.

Also, the thickness of the shadow mask 30 is defined as t, and the width between the center of the smaller hole part 31 and one end of the smaller hole part 31 is Sw/2.

Especially when the end of the larger hole part 32, which is adjacent to the center part of the shadow mask, is located nearer to the center part of the shadow mask than the center of the smaller hole part 31, the slot is configured such that the width Sw of the smaller hole part 31 and the horizontal distance Di between the end of the larger hole part 32, which is adjacent to the center part of the shadow mask 30, and the center of the smaller hole part 31 satisfy the following inequality: $0 \leqq Di \leqq Sw/2$.

When the end of the larger hole part 32, which is adjacent to the center part of the shadow mask, is located nearer to the center part of the shadow mask than the center of the smaller hole part 31, the slot is not affected by the interference between the electron beam and the slot. When Di is larger than Sw/2, the width of the slot of the shadow mask is slightly decreased, and therefore, the structural strength of the shadow mask 30 is not efficiently increased.

Referring to FIG. 11, the slot comprises the smaller hole part 31 and the larger hole part 32, which faces the panel side of the slot. The width of the larger hole part 32 is defined as D.

When one side of the larger hole part 32 of the slot is protruded to decrease the overall area of the slot, the end of the larger hole part 32, which is adjacent to the center part of the shadow mask, is located nearer to the edge part of the shadow mask than the center of the smaller hole part 31, as shown in FIG. 11. In this case, the slot is configured such that the width Sw of the smaller hole part and the width D of the larger hole part satisfy the following inequality: $D \geqq Sw$.

The reason why the slot is configured as described above is that interference may occur between the electron beam and the end of the larger hole part 32, which is adjacent to the center part of the shadow mask, depending on the width D of the larger hole part 32, when the end of the larger hole part 32, which is adjacent to the center part of the shadow mask, is located nearer to the edge part of the shadow mask than the center of the smaller hole part 31. Consequently, the width D of the larger hole part is greater than the width Sw of the smaller hole part, and therefore, the structural strength of the shadow mask 30 is increased within the range in which the interference between the electron beam and the slot is prevented.

In order to sufficiently increase the structural strength of the shadow mask 30, on the other hand, it is preferable to configure the slot such that the width D of the larger hole part 32 and the thickness t of the shadow mask 30 further satisfy the following inequality: $D \leqq 2.5 \times t$.

In other words, the slot is configured such that the inequality of $D \geqq Sw$ is satisfied while the inequality of $D \leqq 2.5 \times t$ is satisfied to increase the structural strength of the shadow mask 30 within the range in which the interference between the electron beam and the slot is prevented.

The following table shows the structural strength of the shadow mask for cathode ray tube according to the present invention.

TABLE 4

| | Structural strength (G) | |
|---|---|---|
| | 29" | 32" |
| Prior art | 20 | 17 |
| Present invention | 22 | 19 |

As can be seen from Table 4, the shadow mask having the slot whose width was decreased within the range in which the interference between the electron beam and the slot was prevented according to the second preferred embodiment of the present invention had a structural strength approximately 10% higher than the conventional shadow mask.

The structural strength of the shadow mask 30 may be calculated by the following equation: $g=C\times E\times t/(r\times R^2)$, where E is effective physical property value, t is thickness of the shadow mask, r is density of the shadow mask, R is the radius of curvature of the shadow mask, and C is a constant.

When an area of the slot formed at the shadow mask 30 is decreased according to the present invention, the effective physical property value is increased, and therefore, the structural strength of the entire shadow mask 30 is increased. Consequently, the structural strength of the shadow mask 30 can be increased without changing the curvature of the shadow mask 30.

In addition to the increase of the structural strength of the shadow mask 30 accomplished by changing the shape of the slot of the shadow mask 30 as described above, the structural strength of the shadow mask 30 may be increased by appropriately changing the arrangement of slots formed at the shadow mask 30.

According to a third preferred embodiment of the present invention, the shadow mask is configured such that Ph(A) of the center part of the shadow mask and Ph(F) of the catercornered end of the effective surface of the shadow mask satisfy the following inequality: $140\% \leqq F/A \leqq 180\%$, where Ph is horizontal distance from the center of one slot to the center of another adjacent slot, whereby the strength at the edge part of the shadow mask is relatively increased as compared to the center part of the shadow mask.

The shadow mask according to the third preferred embodiment of the present invention will be described below in detail with reference to FIGS. 12 and 13.

Figure 12:
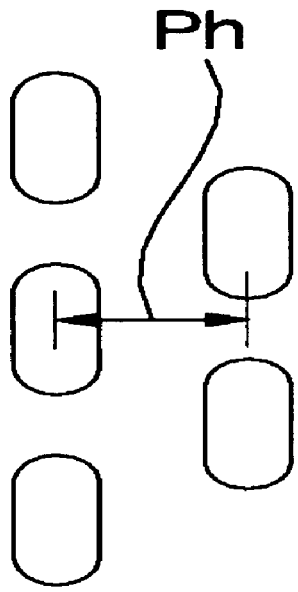
FIG. 12 is a view showing the distance Ph between the respective adjacent slots of the shadow mask.
Figure 13:
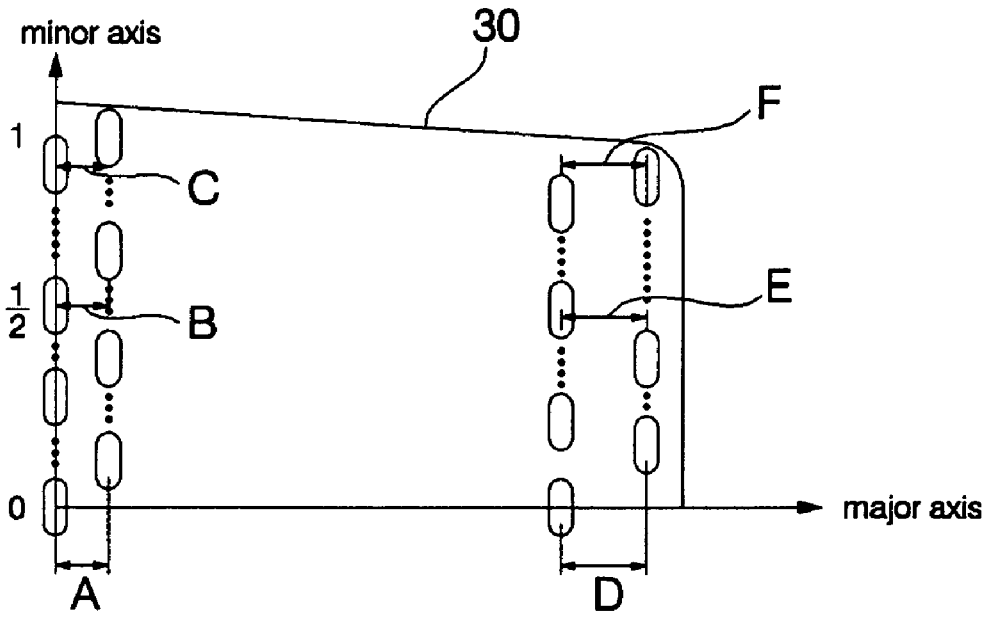
FIG. 13 is a front view showing a shadow mask for cathode ray tubes according to a third preferred embodiment of the present invention.

FIG. 12 is a view showing the distance Ph between the respective adjacent slots of the shadow mask, and FIG. 13 is a front view showing the shadow mask for cathode ray tubes according to the third preferred embodiment of the present invention.

As shown in FIG. 12, the distance between the respective adjacent slots of the shadow mask 30 is defined as Ph.

FIG. 13 shows a quarter of the front surface of the shadow mask for cathode ray tubes according to the present invention. A first slot train is arranged vertically along the minor axis at the center part of the shadow mask 30, and other slot trains are arranged along the minor axis while being parallel with the first slot train along the major axis. In this way, a plurality of slot trains are formed at the shadow mask 30.

Depending upon whether the number of the slot trains formed at the shadow mask while being parallel with one another along the major axis is an odd number or an even number, the slot train formed at the center part of the shadow mask 30 may correspond to the minor axis of the shadow mask 30, or the slot train formed at the center part of the shadow mask 30 may be parallel with the minor axis of the shadow mask 30 while being spaced a predetermined distance from the minor axis of the shadow mask 30.

The horizontal pitch Ph between the center of the slot disposed at the center part of the shadow mask 30 and the center of the slot of the adjacent slot train is defined as A, the horizontal pitch Ph between the center of the slot of the first slot train at the middle position in the direction of the minor axis, i.e., at the position corresponding to ½ of the distance from the center part of the shadow mask to the end of the shadow mask in the direction of the minor axis, and the center of the slot of the second slot train, which is adjacent to the first slot train, is defined as B, and the horizontal pitch Ph between the center of the slot of the first slot train at the end of the shadow mask in the direction of the minor axis and the center of the slot of the second slot train, which is adjacent to the first slot train, is defined as C.

On the assumption that the slot train formed at the end of the shadow mask in the direction of the major axis while being arranged along the minor axis is an $n^{th}$ slot train, the horizontal pitch Ph between the $n^{th}$ slot train and the adjacent $n\text{-}1^{th}$ slot train is also defined. The horizontal pitch Ph between the center of the slot disposed at the end of the effective surface of the shadow mask 30 in the direction of the major axis and the center of the slot of the adjacent slot train is defined as D, the horizontal pitch Ph between the center of the slot of the $n^{th}$ slot train at the middle position in the direction of the minor axis from the end of the effective surface of the shadow mask in the direction of the major axis, i.e., at the position corresponding to ½ of the distance from the end of the effective surface of the shadow mask in the direction of the major axis to the end of the shadow mask in the direction of the minor axis, and the center of the slot of the $n\text{-}1^{th}$ slot train, which is adjacent to the $n^{th}$ the slot train, is defined as E, and the horizontal pitch Ph between the center of the slot of the $n^{th}$ slot train at the catercornered end of the effective surface of the shadow mask and the center of the slot of the $n\text{-}1^{th}$ slot train, which is adjacent to the $n^{th}$ slot train, is defined as F.

In order to accomplish the object of the present invention, the horizontal pitch Ph between the respective slots formed at the shadow mask 30 is gradually increased from the center part of the shadow mask 30 toward the end of the effective surface of the shadow mask in the direction of the major axis, which will be described with reference to Tables 5 to 8.

TABLE 5

| Deflection angle (degrees) | F/A | D/A | E/B | F/C | Drop (G) | Doming (μm) |
|---|---|---|---|---|---|---|
| 90 | 134% | 130% | 132% | 136% | 22.5 | 20.2 |
| 106 | 134% | 130% | 132% | 136% | 19.2 | 22 |
| 110 | 134% | 130% | 132% | 136% | 18.4 | 26 |
| 120 | 134% | 130% | 132% | 136% | 15.5 | 29.2 |
| 125 | 134% | 130% | 132% | 136% | 14.6 | 35.2 |
| 130 | 134% | 130% | 132% | 136% | 12 | 39 |

Table 5 shows the strength and doming characteristics of the shadow mask 30 having slots whose shapes were formed according to the prior art when the shadow mask 30 was applied to various cathode ray tubes having different deflection angles. In the conventional cathode ray tube, not the slim-type cathode ray tube, the deflection angle is below approximately 110 degrees.

Preferably, the strength of the shadow mask is above 15 G. As can be seen from Table 5, the structural strength of the shadow mask was decreased and the doming characteristic of the shadow mask was deteriorated when the ratio of the width of the slot at the end of the effective surface of the shadow mask 30 in the direction of the major axis to the width of the slot at the center part of the shadow mask 30 was formed according to the prior art in the wide-angle cathode ray tube having a deflection angle of 120 degrees or more.

TABLE 6

| Deflection angle (degrees) | F/A | D/A | E/B | F/C | Drop (G) | Doming (μm) |
|---|---|---|---|---|---|---|
| 120 | 140% | 145% | 145% | 145% | 17.2 | 26.8 |
| 125 | 140% | 145% | 145% | 145% | 16.1 | 32.1 |
| 130 | 140% | 145% | 145% | 145% | 13.9 | 36.8 |

TABLE 7

| Deflection angle (degrees) | F/A | D/A | E/B | F/C | Drop (G) | Doming (μm) |
|---|---|---|---|---|---|---|
| 120 | 145% | 145% | 145% | 145% | 18.2 | 25.4 |
| 125 | 145% | 145% | 145% | 145% | 17 | 30 |
| 130 | 145% | 145% | 145% | 145% | 15.1 | 34.2 |

TABLE 8

| Deflection angle (degrees) | F/A | D/A | E/B | F/C | Drop (G) | Doming (μm) |
|---|---|---|---|---|---|---|
| 120 | 150% | 145% | 145% | 145% | 19.6 | 24.3 |
| 125 | 150% | 145% | 145% | 145% | 18.36 | 28.8 |
| 130 | 150% | 145% | 145% | 145% | 17.1 | 32 |

Tables 6 to 8 show the strength and doming characteristics of the shadow mask 30 having slots formed based on the ratio of the horizontal pitch Ph according to the present invention. Especially, Tables 7 and 8 show the characteristics of the shadow mask when the ratio of the horizontal pitch F of the slot at the catercornered end of the effective surface of the shadow mask to the horizontal pitch A of the slot at the center part of the shadow mask 30 was changed.

It can be seen from Table 6 that, when F/A was 140%, and D/A, E/B and F/C were 145%, respectively, the strengths of the shadow mask having slots formed with the above-defined ratios were 17.2, 16.1 and 13.9 at deflection angles of 120 degrees, 125 degrees and 130 degrees, respectively, and therefore, had a structural strength approximately 10% higher than the conventional shadow mask 30 having the small horizontal pitch Ph.

It can also be seen from Table 6 that the doming characteristic of the shadow mask having slots formed with the above-defined ratios was approximately 10% higher than that of the conventional shadow mask having the small horizontal pitch Ph.

Tables 7 and 8 show the characteristics of the shadow mask when the ratio (F/A) of the horizontal pitch F of the slot at the catercornered end of the effective surface of the shadow mask to the horizontal pitch A of the slot of the first slot train at the center part of the shadow mask was 145% and 150%, respectively. As can be seen from Tables 7 and 8, the strength and doming characteristics of the shadow mask when F/A is 145% or 150% were improved as compared with the strength and doming characteristics of the shadow mask when F/A is 140%.

Especially in the case of the cathode ray tube having a deflection angle of 130 degrees or more, the structural strength of the shadow was above 15 G, which was relatively increased as compared with the cathode ray tube having the shadow mask with F/A of 140%. Consequently, deterioration of quality of the cathode ray tube due to decrease of the structural strength and occurrence of vibration is effectively prevented.

When the horizontal pitch Ph is excessively increased, however, the ratio of an area of the slot, through which the electron beam passes, to an area of the shadow mask 30 is excessively decreased, with the result that resolution of the cathode ray tube may be lowered. For this reason, it is preferable that the ratio of the horizontal pitch Ph between the $n^{th}$ slot train and the adjacent slot train to the horizontal pitch Ph between the first slot train and the adjacent slot train is set to below 180%.

When curvature is provided at the shadow mask 30 of the cathode ray tube, the purity characteristic is deteriorated, and therefore, color purity of the cathode ray tube is affected. For this reason, the horizontal pitch Ph is increased toward the corner part of the shadow mask 30 as described above such that the curvature can be provided at the shadow mask 30 of the cathode ray tube without deterioration of the purity characteristic.

In order to prevent interference between the electron beam and the slot of the shadow mask, which may result from the increase of the deflection angle due to slimness of the cathode ray tube, the width of the slot through which the electron beam passes at a large incident angle sufficient to cause interference between the electron beam and the slot is increased. In this case, it is preferable to increase the width of the slot from the position corresponding to ½ of the distance from the center part of the shadow mask 30 to the edge part of the shadow mask 30 in the direction of the major axis. As a result, the horizontal pitch Ph of the slot is successively increased from the position corresponding to ½ of the distance from the center part of the shadow mask 30 to the end of the shadow mask 30 in the direction of the major axis, and therefore, the ratio of the slot defined according to the present invention is satisfied.

When the horizontal pitch Ph of the end of the effective surface of the shadow mask in the direction of the major axis is defined as D, it is preferable to configure the shadow mask such that the following inequality is satisfied: $140\% \leqq D/A \leqq 180\%$.

When the horizontal pitch Ph at the position corresponding to ½ of the distance from the center part of the shadow mask to the end of the shadow mask in the direction of the minor axis is defined as B, and the horizontal pitch Ph at the position corresponding to ½ of the distance from the end of the effective surface of the shadow mask in the direction of the major axis to the end of the shadow mask in the direction of the minor axis is defined as E, it is preferable to configure the shadow mask such that the following inequality is satisfied: $140\% \leqq E/B \leqq 180\%$.

Also, when the horizontal pitch Ph at the end of the effective surface of the shadow mask in the direction of the minor axis is defined as C, it is preferable to configure the shadow mask such that the following inequality is satisfied: $140\% \leqq F/C \leqq 180\%$. Furthermore, it is preferable to configure the shadow mask such that Ph(A) of the center part of the shadow mask and Ph(F) of the catercornered end of the effective surface of the shadow mask further satisfy the following inequality: $150\% \leqq F/A \leqq 180\%$.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As apparent from the above description, the shape of each slot of the shadow mask for cathode ray tubes is appropriately changed such that the width of the slot is optimized. Consequently, the present invention has the effect of preventing interference between the electron beam and the slot, and therefore, preventing a picture displayed on the cathode ray tube from being distorted and brightness at the edge part of the cathode ray rube from being lowered.

Furthermore, the width of each slot of the shadow mask can be reduced or the arrangement of the slots can be appropriately changed within the range in which interference does not occur between the shadow mask and the electron beam. Consequently, the present invention has the effect of preventing the decrease of the structural strength of the shadow mask, which is caused by flattening the shadow mask and increasing the width of each slot.

What is claimed is:

1. A shadow mask for cathode ray tubes, the shadow mask having a plurality of slots through which an electron beam passes for sorting colors of the electron beam, wherein when the width of a smaller hole part of each of the slots through which the electron beam passes is defined as Sw, the horizontal distance between the end of a taper-shaped larger hole part facing the panel side of each of the slots, which is adjacent to the edge part of the shadow mask, and the end of the smaller hole part, which is adjacent to the edge part of the shadow mask, is defined as Ta, and the incident angle at which the electron beam passes through each of the slots is defined as θ, the shadow mask has at least one slot through which the electron beam passes at an incident angle θ of above 47 degrees, and the at least one slot through which the electron beam passes at an incident angle θ of above 47 degrees is configured such that the following inequality is satisfied:

$$1<Ta/Sw<2.$$

2. The mask as set forth in claim 1, wherein when the thickness of the shadow mask is defined as t, the at least one slot of the shadow mask is configured such that the following inequality is further satisfied:

$$1<Ta/t<2.$$

3. The mask as set forth in claim 1, wherein the at least one slot of the shadow mask is configured such that the following inequality is further satisfied:

$$Ta<0.380 \text{ mm}.$$

4. The mask as set forth in claim 1, wherein the end of the larger hole part, which is adjacent to the center part of the shadow mask, is protruded toward the center of the at least one slot.

5. The mask as set forth in claim 4, wherein the end of the larger hole part, which is adjacent to the center part of the shadow mask, is located nearer to the center part of the shadow mask than the center of the smaller hole part, and when the horizontal distance between the end of the larger hole part, which is adjacent to the center part of the shadow mask, and the center of the smaller hole part is defined as Di, the at least one slot is configured such that the following inequality is satisfied:

$$0\leqq Di\leqq Sw/2.$$

6. The mask as set forth in claim 4, wherein the end of the larger hole part, which is adjacent to the center part of the shadow mask, is located nearer to the edge part of the shadow mask than the center of the smaller hole part, and when the width of the larger hole part is defined as D, the at least one slot is configured such that the following inequality is satisfied:

$$D\geqq Sw.$$

7. The mask as set forth in claim 4, wherein when the width of the larger hole part is defined as D and the thickness of the shadow mask is defined as t, the at least one slot is configured such that the following inequality is satisfied:

$$D\leqq 2.5\times t.$$

8. The mask as set forth in claim 1, wherein when the horizontal distance from the center of one slot of the shadow mask to the center of another adjacent slot is defined as Ph, the shadow mask is configured such that Ph(A) of the center part of the shadow mask and Ph(F) of the catercornered end of the effective surface of the shadow mask satisfy the following inequality.

$$140\%\leqq F/A\leqq 180\%.$$

9. The mask as set forth in claim 8, wherein when Ph of the end of the effective surface of the shadow mask in the direction of the major axis is defined as D, the shadow mask is configured such that the following inequality is satisfied:

$$140\%\leqq D/A\leqq 180\%.$$

10. The mask as set forth in claim 8, wherein when Ph at the position corresponding to ½ of the distance from the center part of the shadow mask to the end of the shadow mask in the direction of the minor axis is defined as B, and Ph at the position corresponding to ½ of the distance from the end of the effective surface of the shadow mask in the direction of the major axis to the end of the shadow mask in the direction of the minor axis is defined as E, the shadow mask is configured such that the following inequality is satisfied:

$$140\%\leqq E/B\leqq 180\%.$$

11. The mask as set forth in claim 8, wherein when Ph at the end of the effective surface of the shadow mask in the direction of the minor axis is defined as C, the shadow mask is configured such that the following inequality is satisfied:

$$140\%\leqq F/C\leqq 180\%.$$

12. The mask as set forth in claim 8, wherein the shadow mask is configured such that Ph(A) of the center part of the shadow mask and Ph(F) of the catercornered end of the effective surface of the shadow mask further satisfy the following inequality:

$$150\%\leqq F/A\leqq 180\%.$$

13. The mask as set forth in claim 1, wherein the shadow mask is applied to a slim-type cathode ray tube having a deflection angle of 120 degrees or more.

14. A shadow mask for cathode ray tubes, the shadow mask having a plurality of slots through which an electron beam passes for sorting colors of the electron beam, wherein each of the slots includes a smaller hole part having the narrowest width and a larger hole part facing the panel side of each of the slots, and the end of the larger hole part, which is adjacent to the center part of the shadow mask, is protruded toward the center of each of the slots such that an area of each of the slots is decreased to increase the structural strength of the shadow mask, wherein the end of the larger hole part, which is adjacent to the center part of the shadow mask, is located nearer to the center part of the shadow mask than the center of the smaller hole part, and when the width of the smaller hole part is defined as Sw, and the horizontal distance between the end of the larger hole part, which is adjacent to the center part of the shadow mask, and the center of the smaller hole part is defined as Di, the shadow mask is configured such that the following inequality is satisfied:

$$0 \leqq Di \leqq Sw/2.$$

15. A shadow mask for cathode ray tubes, the shadow mask having a plurality of slots through which an electron beam passes for sorting colors of the electron beam, wherein each of the slots includes a smaller hole part having the narrowest width and a larger hole part facing the panel side of each of the slots, and the end of the larger hole part, which is adjacent to the center part of the shadow mask, is protruded toward the center of each of the slots such that an area of each of the slots is decreased to increase the structural strength of the shadow mask, wherein the end of the larger hole part, which is adjacent to the center part of the shadow mask, is located nearer to the edge part of the shadow mask than the center of the smaller hole part, and when the width of the smaller hole part is defined as Sw, and the width of the larger hole part is defined as D, the shadow mask is configured such that the following inequality is satisfied:

$$D \geqq Sw.$$

* * * * *